US010076179B2

(12) United States Patent
Asay

(10) Patent No.: US 10,076,179 B2
(45) Date of Patent: Sep. 18, 2018

(54) SECURE CELL

(71) Applicant: Jorge Asay, Lancaster, CA (US)

(72) Inventor: Jorge Asay, Lancaster, CA (US)

( * ) Notice: Subject to any disclaimer, the term of this patent is extended or adjusted under 35 U.S.C. 154(b) by 161 days.

(21) Appl. No.: 14/850,782

(22) Filed: Sep. 10, 2015

(65) Prior Publication Data

US 2016/0066677 A1 Mar. 10, 2016

Related U.S. Application Data

(60) Provisional application No. 62/070,902, filed on Sep. 10, 2014.

(51) Int. Cl.
*A45F 3/10* (2006.01)
*A45F 5/02* (2006.01)

(52) U.S. Cl.
CPC ..... *A45F 5/021* (2013.01); *A45F 2200/0516* (2013.01)

(58) Field of Classification Search
CPC ..... A45F 5/021; A45F 2200/0516
USPC ..... 224/667
See application file for complete search history.

(56) References Cited

U.S. PATENT DOCUMENTS 3,148,812 A * 9/1964 Hilsinger, Jr. ..... A45F 5/02 206/5
4,047,650 A * 9/1977 Domingos ..... A45F 5/02 224/223
4,174,793 A * 11/1979 Wisowaty ..... A45C 1/04 224/240
5,458,267 A * 10/1995 Curtis ..... A45F 5/02 2/338
5,964,386 A * 10/1999 Cote ..... A45F 5/02 224/236
2007/0226958 A1* 10/2007 Clifton, Jr. ..... A45F 5/02 24/3.12
2012/0181311 A1* 7/2012 Stevens, IV ..... A41F 9/002 224/197
2013/0181083 A1* 7/2013 Salentine ..... B65H 75/48 242/399.2

* cited by examiner

*Primary Examiner* — Derek Battisti
(74) *Attorney, Agent, or Firm* — Monty Simmons; Simmons Patents

(57) ABSTRACT

The disclosed technology is a secure-cell apparatus for releasably securely associating a device, such as a cellular phone, with a device user. The device is configured to clamp to a support structure such as a strap, belt, seatbelt, and suspenders. The secure-cell apparatus my further define a zone for storing items such as keys, cards, IDs, etc. Such "zone" may further define a personality interface configured to receive a personality module. Personality modules are in electrical communication with an electronic device associated with the secure-cell apparatus and may add additional functionality to such electronic device.

11 Claims, 4 Drawing Sheets

SECURE CELL

CLAIM TO PRIORITY

This application claims priority to provisional application 62/070,902, filed on 10 Sep. 2014, of which the entire contents of such reference are incorporated herein by this reference for all that it discloses for all purposes.

TECHNICAL FIELD

The invention relates to methods and apparatuses for stowing and securing portable devices such as cellular telephones.

BACKGROUND OF THE INVENTION

As is well known, the belt is a flexible band or strap, typically made of leather or heavy cloth. Belts can be worn around the waist to support trousers or pants or other articles of clothing. Similarly, suspenders or braces (British) consists of straps, made from fabric or leather, typically worn over the shoulders to hold a trousers/pants. Belts can also be used for devices such as seatbelts. It did not take long for people to realize that belts/straps can be used to support other items such as utility belts, key chains, tape measures, cell phones, and other items.

Today there are a multitude of belt accessories designed to secure some item to a belt/strap/suspender. Such items may be very expensive and relatively fragile (e.g. cellular telephones). Some items may be relatively difficult to damage (e.g. keys). Notably, such items could become lost or damaged if the belt accessory securing the item to a user's belt accidentally separates from the user's belt. Consequently, it is important for belt accessories used to secure items to a user's belt not to fail.

Today there are a multitude of the patents covering belt accessories configured for associating items to a user's belt and such patented devices are often referred to as "clips". Such patents cover adjustable belt clips, bidirectional belt clip, car seat belt clips, spring-loaded belt clips, belt clips for a hand-held power tools, and belt clips with breakaway safety features. And the list goes on and on. That said, such prior art clips fail to adequately secure the belt clip to an user's belt or strap in a way that is both secure yet easily releasable.

The disclosed inventions relate to devices and methods for securing an item to a support structure such as a belt/strap/suspender.

SUMMARY OF THE INVENTION

Some of the objects and advantages of the invention will now be set forth in the following description, while other objects and advantages of the invention may be obvious from the description, or may be learned through practice of the invention.

Broadly speaking, a principle object of the present invention is to provide a method and apparatus for releasably and securely associating a device with a support structure (such as a belt) associated with a user.

Another general object of the present invention is to provide a method and apparatus for releasably and securely associating a device with a support structure (such as a belt) associated with a user where such apparatus further provides a zone for storing items.

Still another general object of the invention is to provide a method and apparatus for releasably and securely associating a device with a support structure (such as a belt) associated with a user where such apparatus further provides a zone for receiving personality modules.

A still further object of the invention is to provide personality modules configured to add functionality to a device associated with the apparatus described above.

For one embodiment, such apparatus is called a secure-cell device comprising a first body portion and a second body portion connected by a flexible region to define a gap between the first body portion and the second body portion. The first portion defines a first surface and an opposing second surface connected by a peripheral edge (i.e. a plate, for example, with a thickness defined by the length of the peripheral edge), wherein the perimeter of said first body portion defines a first polygonal shape.

The second body portion also defines a first surface and an opposing second surface connected by a peripheral edge, wherein the perimeter of said second body portion defines a second polygonal shape. The first polygonal shape and second polygonal shape may or may not be the same.

There is at least one Adjuster element configured to move at least one of the first body portion and the second body portion in a direction that decrease the size of the gap thereby creating a clamping action between the first body portion and the second body portion. The first body portion is ideally configured to releasably receive a case or it defines an integral case. Examples of support structures include seatbelts, belts, and suspenders associated with a user.

For one embodiment, at least one of the first body portion and second body portion defines a void configured for storing items. Such void may also define a personality interface configured for receiving and being electrically associated with a personality module. Personality modules are just that, a module that define the "personality" of the secure-cell device. The personality module is placed in communication with the electronic device associated with the secure-cell device. Such personality module preferably adds functionality to such electronic device and thereby changes the secure-cell device from a simple passive storage case to an electronic accessory that provides additional functions as defined by the personality module.

Additional objects and advantages of the present invention are set forth in the detailed description herein or will be apparent to those skilled in the art upon reviewing the detailed description. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

Those of ordinary skill in the art will better appreciate the features and aspects of such embodiments, and others, upon review of the remainder of the specification.

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
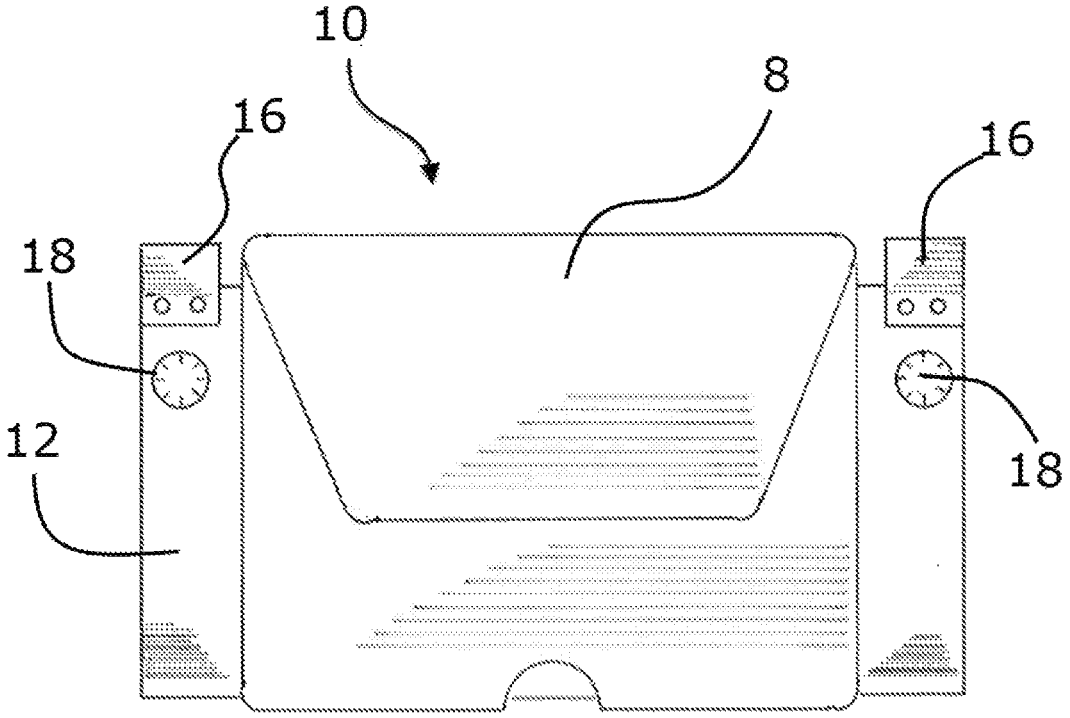
FIG. 1 is front elevational view of one embodiment of a secure-cell device associated with a case for holding items.

Repeat use of reference characters throughout the present specification and appended drawings is intended to represent the same or analogous features or elements of the present technology.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

Construction Aids

For the purposes of this document two or more items are "mechanically associated" by bringing them together or into relationship with each other in any number of ways including a direct or indirect physical "releasable connections" (snaps, screws, Velcro®, bolts, etc.—generally connections designed to be easily and frequently released and reconnected), "hard-connections" (welds, rivets, macular bonds, generally connections that one does not anticipate disconnecting very often if at all and where one generally needs to "break" to separate), and/or "moveable connections" (rotating, pivoting, oscillating, etc.).

This document includes headers that are used for place markers only. Such headers are not meant to affect the construction of this document, do not in any way relate to the meaning of this document nor should such headers be used for such purposes.

While the particulars of the present invention and associated technology may be more frequently described for use with cell phones and similar devices, the disclosed technology may be used in any number of fields where there is a need to removably and securely associate two items.

Referring now to FIG. 1, presented is one exemplary embodiment of a secure-cell device (SCD) (10) associated with a case (8) configured for holding items such as a cell phone. The SCD (10) is configured to be releasably mechanically associate with a support structure such as a belt/strap/suspender as described below. For such currently preferred embodiment, SCD (10) comprises a first body portion (12) defining a first surface with first polygonal perimeter associated with a second body portion (14) defining a second surface with a second polygonal perimeter by flex portion (16) so that such body portions are in alignment with a gap (20) defined there between. For the purposes of this document circles are polygons, and for the preferred embodiment, the perimeter of the first and second body portion define a rectangular shape of equal sizes. One of ordinary skill in the art will appreciated that any suitably shaped perimeter may be used and the perimeter shapes may not be equal size and may define different shapes.

Case (8) is one of (i) an integral component of SCD (10), (ii) a component hard-fastened to one of the first body portion and the second body portion, and (iii) a component that is releasably mechanically associated with SCD (10) using any suitable fastening technology. Case (8) is ideally integral to or associated with first body portion (12) as depicted in FIG. 1. Notably, SCD (10) may be configured without a case (8) as depict in FIG. 2 and provides any suitable well known scheme/mechanism/system for associating a case or similar item with to the SCD (10).

Adjuster element (18) is configured to move at least one of the first body portion (12) and the second body portion (14) in a direction that decreases the size of gap (20) thereby creating a clamping action between the first surface defined by first body portion (12) and the second surface defined by second body portion (14). Notably, as depicted in FIG. 1 through FIG. 3, the SCD (10) device may comprise two Adjuster elements, one each disposed at two opposing sides of the SCD (10) with the case (8) disposed there between.

Figure 2:
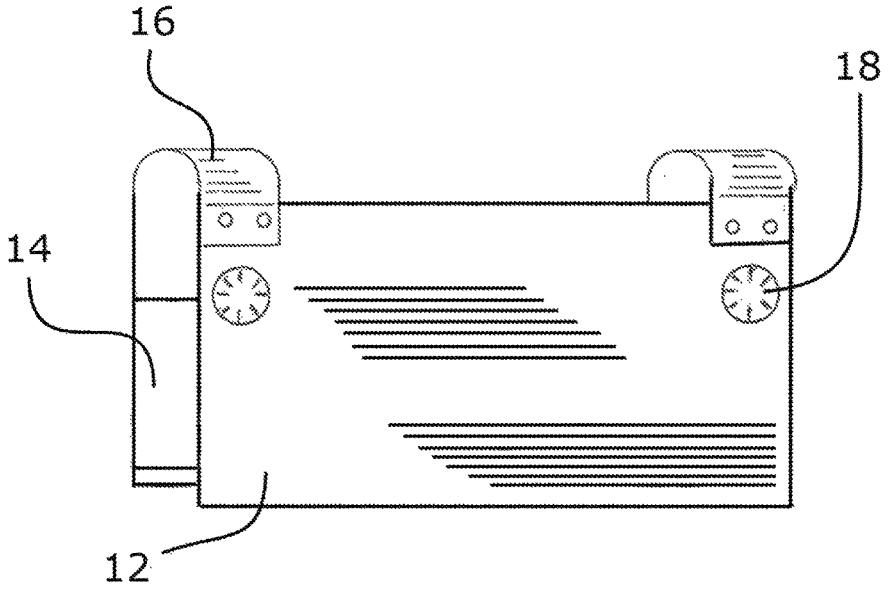
FIG. 2 is a front perspective view of the secure-cell device depicted in FIG. 1 without a case.
Figure 3:
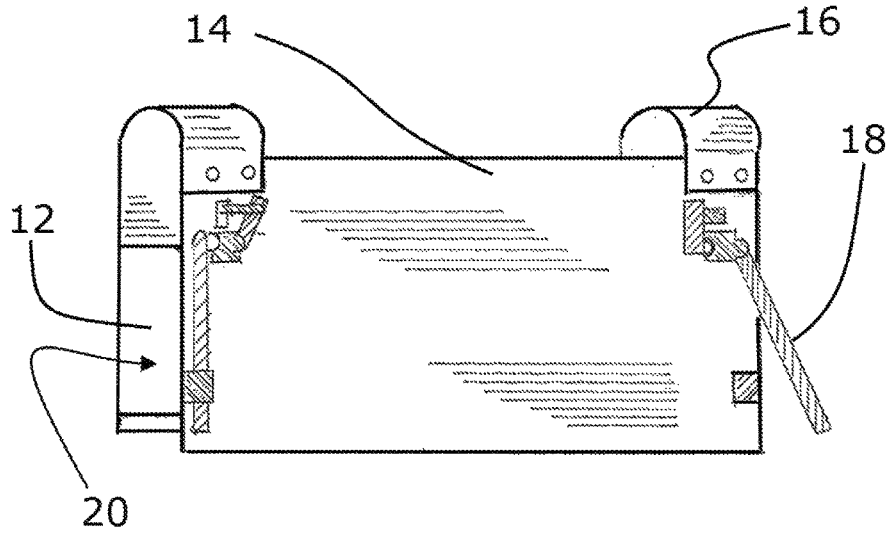
FIG. 3 is a rear perspective view of one alternative embodiment of a secure-cell device.
Figure 4:
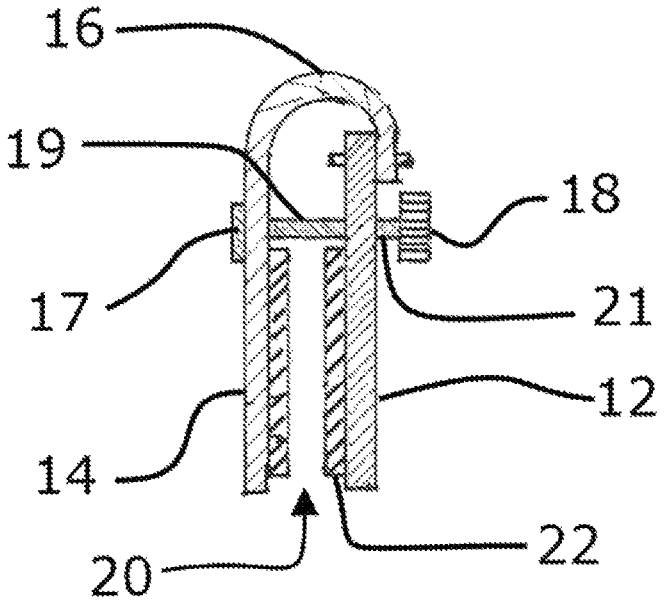
FIG. 4 is a side elevational view of the secure-cell device depicted in FIG. 2 configured with a rotating clamp Adjuster.

As depicted in FIG. 2 and FIG. 4, for one configuration, an Adjuster element (18) may define an Adjuster assembly defining a rotating gap-Adjuster comprising an extension (19) defining a first end (17) associated with the second body portion (14) and extending through said first body portion (12) to a second end (21) defining threads configured for mechanically associating with rotating gap-Adjuster (18). For the currently preferred embodiment, there are two adjuster elements (18) disposed at two opposing ends of the SCD (10) device as in FIG. 2.

Rotating gap-Adjuster (18) in a first direction allows for or decreases the size of gap (20) and rotating gap-Adjuster (18) in a second direction allows for or increase the size of gap (20). Suitable embodiments of an extension (19) include at least bolts, carriage bolts, machine screws/bolts, threaded rods, etc. Suitable embodiments of a gap-Adjuster (18) include hex nuts, nylon insert nuts, thumb nuts, knurled thumbed nuts, etc.

Figure 5:
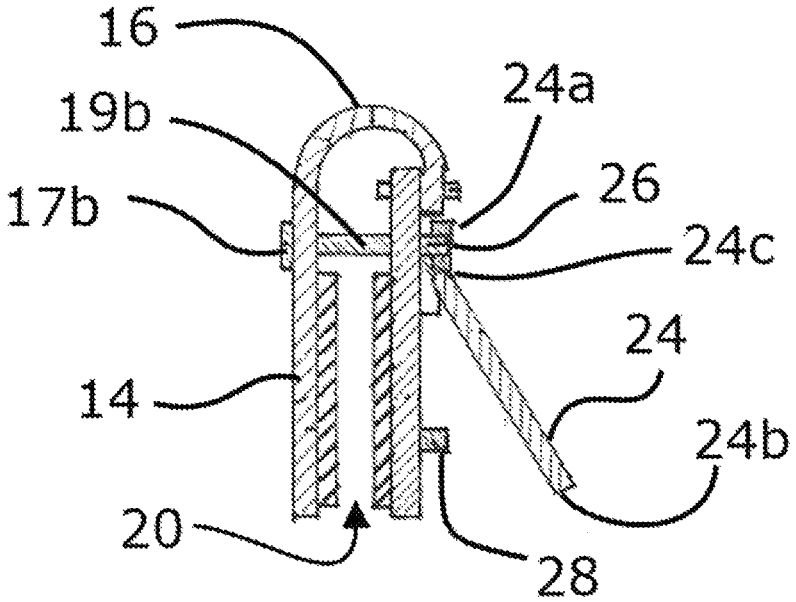
FIG. 5 is a side elevational view of the secure-cell device depicted in FIG. 3 configured with a linear clamp Adjuster.

As depicted in FIG. 5, for one configuration, Adjuster element (18) is an assembly defining a more linear gap-Adjuster (compared to the rotating gap Adjuster disclosed above) comprising an extension (19*a*) and lever element (24). Extension (19*a*) defines a first end (17*b*) associated with the second body portion (14) and extending through the first body portion (12) to a second end defining an extension interface (26). For the currently preferred embodiment, extension interface (26) is configured to be moveably mechanically associated with a first lever portion (24*a*) defined by lever element (24).

For one exemplary embodiment, lever element (24) defines a first lever portion (24*a*) and a second lever port (24*b*) separated by a fulcrum point (24*c*). As depicted in FIG. 5, first lever portion (24*a*) and second lever portion (24*b*) define an angle there between creating fulcrum point (24*c*). Preferably, second lever portion (24*b*) is longer than the first lever portion (24*a*) to create a mechanical advantage that amplifies the force exerted at extension interface (26).

One of ordinary skill in the art will appreciate that applying pressure/force on first lever portion (24*b*) will cause first lever portion (24*b*) to move toward the first body portion (12). Such force will be amplified by the mechanical advantage created by fulcrum (24*c*) and applied to extension interface (26) thereby creating a force that tends to move first body portion (12) toward second body portion (14) creating a clamping action there between. Ideally, sufficient pressure is placed on first lever portion (24*b*) so that the first lever portion (24*b*) mechanically associates with latching element (28) to secure the first lever portion (24*b*) in the engaged position. Any suitable latching technology may be use for the latching element (28) including magnetic elements. As before, there are preferably two such adjuster elements (18) disposed at two opposing ends of the SCD (10) device as in FIG. 3.

Personality Interface

Figure 6:
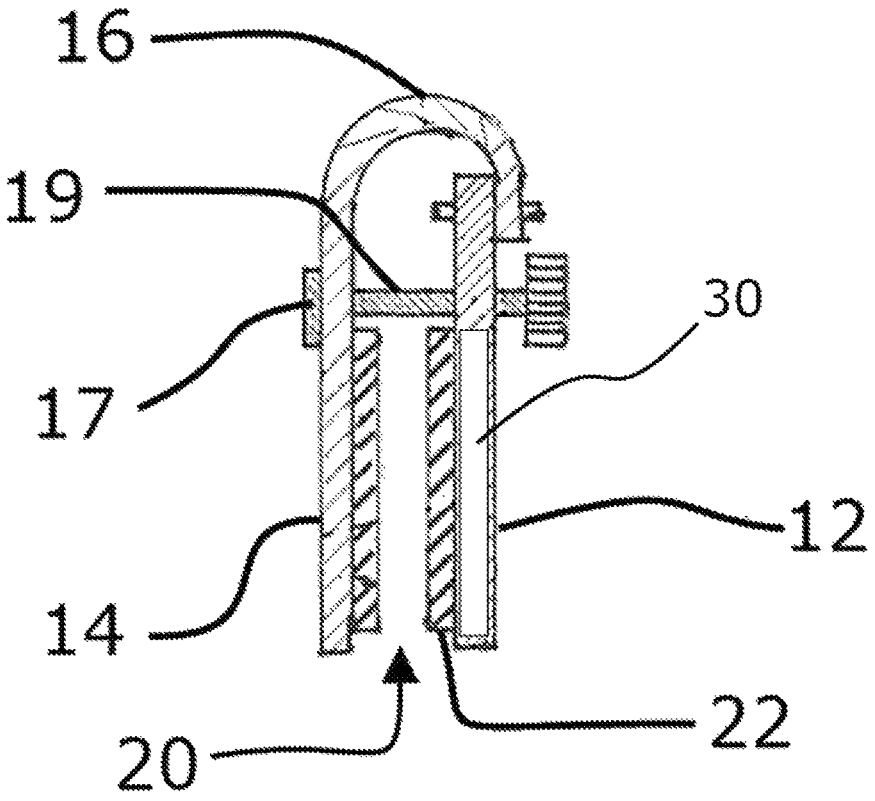
FIG. 6 is a side elevational view of the secured-cell device depicted in FIG. 2 comprising a zone configured for receiving items and/or personality modules.

Referring now to FIG. 6 , one alternative embodiment of the SCD (10) is presented. For such embodiment at least one of the first body portion and second body portion define a zone (30). Zone (30) may be a compartment configured for storing items such as credit cards or a key. For one embodiment, Zone (30) is a compartment configured for receiving personality modules. Personality modules are electronic modules configured for communicating and/or supplying power to an electronic device associated with the SCD (10).

One such personality module comprises a processing device associated with or comprising integral communication circuits and at least one sensor (temperature, acceleration, acoustic, vibration, light, voltage, current, etc.). Suitable processing devices include low power consumption PICs or microprocessor such as ASICs (application specific integrated circuit) or ASSPs (application specific standard product). The communication circuits are configured to communicate with or signal an electronic device associated SCD (10). For one embodiment, the SCD (10) is configured with communication circuits and an acceleration sensor and is configured to detect a device-signal from the device the user normally associates with the SCD (10) and to generate an alert when such device-signal is not present and the acceleration sensor detects movement.

Such feature would ideally be used to alert a user he/she has forgotten or "lost" the device that should be associated with the SCD (10). For example, where the device associated with the SCD (10) is a cellular phone, the communication circuits would ideally be Bluetooth and the cellular phone would be paired with the SCD (10). If the SCD (10) detects movement (via the acceleration sensor) and no signal from the cellular phone, such would indicate the SCD (10) user has forgotten or is about to "lose" his/her cellular phone. The SCD (10) would issue an alert that would indicated to such user of the "no cellular signal" condition.

Another personality module would be a security module configured to provide security related functions. For such embodiment, the personality module would ideally comprise the same communication circuits as before and would also provide an action-motivator. Embodiments of an action-activator include a "panic button" (for some embodiments). Should a user be attached or be in an emergency situation, the user would press the action-motivator and the SCD (10) would signal the electronic device associated with the SCD (10) to execute a predefined set of actions. Such actions may include calling a predefined number(s) (perhaps 911) and/or to send text messages and e-mails perhaps containing image and sound data. Such actions could include turning on a cell phone camera and recording sound and image data and transferring at least part of such data to a remote device along with location information (e.g. GPS coordinates). Further, should the acceleration sensor detect acceleration of sufficient strength to indicated a life threading event, (such as a car crash), the SCD would ideally automatically alert an associated cell phone (for example) to call a predefined number(s) (e.g. 911) and transmit location data and threat type information as well as any other information desired.

For one embodiment, the personality module would be a simple power source configured to charge the device associated with the SCD (10).

Any number of "personality modules" could be engineered by any number of people and associated with zone (30) to add functionality to devices associated with the SCD (10). Notably, downloading "Software APPS" programmed by various people to enhance the functionality of a cell phone is well known and a very useful feature for smart phones. Similarly, providing the Zone (30) personality module interface is the hardware version of "Software APPS" allowing anyone to created personality modules to enhance the functionality of their devices associated with the SCD (10).

The components of SCD (10) may be constructed from any suitable materials such as metal, steel, composite materials, etc. as desired by the user and the various components may formed by one integral piece or a plurality of pieces.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A secure-cell device configured to releasably mechanically associate with a support structure, said secure-cell device comprising: a first body portion defining a first portion first surface and an opposing first portion second surface connected by a peripheral edge, where in the perimeter of said first body portion defines a first polygonal shape; a second body portion defining a second portion first surface and an opposing second portion second surface connected by a peripheral edge, wherein the perimeter of said body portion defines a second polygonal shape; a third portion connecting said first body portion to said second body portion so that said body portions are in alignment to define a gap there between and wherein said third portion is one of (i) removably mechanically associated with said first and second body portions (ii) integral to said second body portion, and (iii) integral to said first and second body portion; at least one adjuster element configured to move at least one of said first body portion and said second body portion in a direction that decrease the size of said gap thereby creating an adjustable clamping action between said first body portion and said second body portion to securely clap said secure-cell to said support structure wherein said adjuster element defines a linear gap-adjuster comprising a non-straight lever defining a fulcrum point creating a mechanical advantage to reduce the force needed to engage said linear gap-adjust; and at least one storage void defined by at least one of (i) said first body portion between said first portion first surface and said first portion second surface, and (ii) said second body portion between said second portion first surface and said second portion second surface wherein said storage void is configured for storing items; wherein one of said first body portion and said second body portion is one of (i) configured for receiving a case, (ii) defines an integral case, and (iii) hard-fastened to a case.

2. A secure-cell device as in claim 1, wherein said third portion defines a flex portion and said support structure is a strap and wherein the first body portion and said second body portion are suitably sized for clamping to said strap.

3. A secure-cell device as in claim 2, wherein said strap is one of a seatbelt, belt, and suspender.

4. A secure-cell device as in claim 1, wherein said case is suitably sized for housing a cellular phone and said storage void is suitably sized for storing a credit card.

5. A secure-cell device as in claim 4, comprising two adjuster elements with one each disposed at opposing ends of said first and second body portions.

6. A secure-cell device as in claim 1, wherein said storage void further defines a personality interface configured for receiving at least one personality module.

7. A secure-cell device configured to releasably mechanically associate with a support structure, said secure-cell device comprising: a first body portion defining a first portion first surface and an opposing first portion second surface connected by a peripheral edge, where in the perimeter of said first body portion defines a first polygonal shape; a second body portion defining a second portion first surface and an opposing second portion second surface connected by a peripheral edge, wherein the perimeter of said body portion 5 defines a second polygonal shape wherein said second polygonal shape is equal to or similar to said first polygonal shape; a third portion connecting said first body portion to said second body portion so that said body portions are in alignment with each other thereby defining a gap there between and wherein said third portion is flexible and resilient and is one of (i) removably mechanically associated with at least one said first and second body portions, (ii) integral to said second body portion, and (iii) integral to said first body portion and said second body portion; a first storage area mechanically associated with said first body portion suitably sized to receive a cellular phone; a second storage area defined by said second body portion between said second portion first surface and said second portion second surface wherein said second storage area is suitably sized for storing at least one of (a) at least one credit card and (b) at least one key; and at least one adjuster assembly defining a linear gap-adjuster comprising a non-straight lever defining a fulcrum point creating a mechanical advantage to reduce the force needed to engage said linear gap-adjust and wherein said adjuster assembly is configured to move at least one of said first body portion and said second body portion in a direction that decrease the size of said gap thereby creating an adjustable clamping action between said first body portion and said second body portion to securely clap said secure-cell to said support structure.

8. A secure-cell device as in claim 7, wherein said support structure is at least one of a seatbelt, belt, and suspender.

9. A secure-cell device as in claim 8, wherein said first storage area is removable.

10. A method of releasably and securely associating a cellular phone with a user, said method comprising the steps of: providing a secure-cell device comprising a first body portion and a second body portion connected by flexible portion to create a gap between said first body portion and said second body portion; providing an adjustor assembly defining (ii) a linear gap-adjuster comprising a non-straight lever defining a fulcrum point creating a mechanical advantage to reduce the force needed to engage said linear gap-adjust and wherein each said adjuster assembly is configured to move at least one of said first body 7 portion and said second body portion in a direction that decrease the size of said gap thereby creating an adjustable clamping action between said first body portion and said second body portion; associating a cellular phone storage case to said first body portion; configuring at least one of said first body portion and said second body portion with an internal void defining a second storage area for storing items; and placing at least part of a support structure inside said gap and adjusting said at least two adjuster assemblies so that said body portions securely clamp to said support structure.

11. A method of releasably and securely associating a cellular phone with a user as in claim 10, wherein said support structure is one of seatbelt, belt, and suspender.

* * * * *